US007212769B2

(12) United States Patent
Nishimura

(10) Patent No.: US 7,212,769 B2
(45) Date of Patent: May 1, 2007

(54) PROCESS CARTRIDGE AND IMAGE FORMING APPARATUS

(75) Inventor: Soichiro Nishimura, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 257 days.

(21) Appl. No.: 11/057,227

(22) Filed: Feb. 15, 2005

(65) Prior Publication Data

US 2005/0191088 A1 Sep. 1, 2005

(30) Foreign Application Priority Data

Feb. 27, 2004 (JP) ..... 2004-053106

(51) Int. Cl.
*G03G 21/16* (2006.01)

(52) U.S. Cl. ..... 399/111

(58) Field of Classification Search ..... 399/107, 399/108, 110, 111, 116, 117, 121
See application file for complete search history.

(56) References Cited

U.S. PATENT DOCUMENTS 5,734,953 A * 3/1998 Tatsumi ..... 399/262
5,937,242 A * 8/1999 Yokoyama et al. ..... 399/114
6,041,203 A 3/2000 Suzuki et al.
6,330,410 B1 12/2001 Okabe et al.
6,411,789 B1 6/2002 Okabe et al.
6,546,217 B2 4/2003 Okabe et al.
6,690,903 B2 2/2004 Okabe et al.
6,792,229 B2 * 9/2004 Matsuzaki ..... 399/111
6,826,373 B2 * 11/2004 Nomura ..... 399/12
2004/0126132 A1 7/2004 Okabe et al.

FOREIGN PATENT DOCUMENTS

| | | |
|---|---|---|
| EP | 1 031 891 A1 | 8/2000 |
| JP | A-01-179952 | 7/1989 |
| JP | A-04-149562 | 5/1992 |
| JP | A-04-156470 | 5/1992 |
| JP | A-05-014657 | 1/1993 |
| JP | A-06-214435 | 8/1994 |
| JP | A-07-230197 | 8/1995 |
| JP | A-2000-172048 | 6/2000 |
| JP | A-2000-267547 | 9/2000 |

* cited by examiner

*Primary Examiner*—Hoan Tran
(74) *Attorney, Agent, or Firm*—Oliff & Berridge, PLC

(57) ABSTRACT

A process cartridge that includes a frame with a first side wall, a second side wall, a bottom wall and a front wall, an image carrying member, a guide member, a first opening in the bottom wall, and a second opening in the bottom wall is provided. The image carrying member is supported by and extends between the first side wall and the second side wall in a manner that permits the image carrying member to rotate, and the image carrying member projects, at least in part, beyond a bottom surface of the bottom wall. The guide member extends between the first side wall and the second side wall and forms part of the bottom wall. The first opening in the bottom wall extends from the first side wall to the second side wall and is provided between the front wall and the guide member. The second opening in the bottom wall extends from the first side wall to the second side wall and is provided between the guide member and the image carrying member.

20 Claims, 4 Drawing Sheets

PROCESS CARTRIDGE AND IMAGE FORMING APPARATUS

CROSS-REFERENCE TO RELATED APPLICATION

This application claims priority from JP 2004-053106, filed Feb. 27, 2004, the subject matter of which is incorporated herein by reference in its entirety.

BACKGROUND

Known image forming apparatuses, such as laser printers, generally include an attachable/detachable process cartridge that includes a photosensitive drum for carrying a toner image, which is formed by developing an electrostatic latent image on the photosensitive drum. The toner image carried on the photosensitive drum is generally transferred onto a sheet that is fed between the photosensitive drum and a transfer roller. The transfer roller is disposed so as to confront the photosensitive drum.

In some image forming apparatuses, such as the image forming apparatus disclosed in Japanese Laid-Open Patent Publication No. 2000-267547, a transfer roller is provided in a process cartridge. Process cartridges including transfer rollers are generally larger in size. An image forming apparatus that is capable of accommodating such a process cartridge generally needs to allocate a larger space for installing/removing the larger-sized process cartridge into/from the image forming apparatus. Thus, the overall size of such an image forming apparatus must also be larger.

To avoid such problems, in some image forming apparatuses, a transfer roller is provided on a frame of the image forming apparatus rather than on a process cartridge. Because the transfer roller is provided on the frame of the image forming apparatus, a smaller process cartridge can be produced. As a result, the amount of space allocated in the image forming apparatus for installing and removing the process cartridge may be reduced and the overall size of the image forming apparatus may also be reduced.

When a transfer roller is provided on a frame of an image forming apparatus rather than on a process cartridge, a portion of the photosensitive drum that faces the transfer roller will be exposed when the process cartridge is detached/removed from the image forming apparatus. Such exposure of the photosensitive drum can result in damage to the photosensitive drum.

To reduce the possibility of such damage to a photosensitive drum, an openable/closeable shutter for covering the exposed part of the photosensitive drum can be provided on the process cartridge. When the process cartridge is removed from the image forming apparatus, the shutter is closed to cover the part of the photosensitive drum that would otherwise be exposed. When the process cartridge is set in the image forming apparatus, the shutter is opened to expose part of the photosensitive drum.

Providing such a shutter, however, increases the number of components needed to manufacture a process cartridge, and causes complex structures to be included on the process cartridge. As a result, the cost of manufacturing the process cartridge, and, in turn, the image forming apparatus capable of accommodating such a process cartridge increases.

SUMMARY

According to an exemplary aspect of the invention, a smaller sized process cartridge that employs a simple structure for reducing, and preferably preventing, damage to an image carrying member without increasing the manufacturing cost of the process cartridge is provided. In various exemplary embodiments employing one or more aspects of the invention, a smaller sized image forming apparatus that is capable of accommodating the attachable/detachable process cartridge is provided.

According to another exemplary aspect of the invention, a process cartridge that includes a frame with a first side wall, a second side wall, a bottom wall and a front wall, an image carrying member, a guide member, a first opening in the bottom wall, and a second opening in the bottom wall is provided. The image carrying member is supported by and extends between the first side wall and the second side wall in a manner that permits the image carrying member to rotate, and the image carrying member projects, at least in part, beyond a bottom surface of the bottom wall. The guide member extends between the first side wall and the second side wall and forms part of the bottom wall. The first opening in the bottom wall extends from the first side wall to the second side wall and is provided between the front wall and the guide member. The second opening in the bottom wall extends from the first side wall to the second side wall and is provided between the guide member and the image carrying member.

According to another exemplary aspect of the invention, a process cartridge that includes a guide member and is capable of being removably installed in an image forming apparatus that includes a transfer device, for transferring a developer image from an image carrying member to a transfer medium, is provided. The image carrying member is positioned to oppose the transfer device when the process cartridge is removably installed in the image forming apparatus. The guide member is provided adjacent to and extending along a length of the image carrying member. In various exemplary embodiments, the guide member is positioned so that, when the process cartridge is installed in the image forming apparatus, the guide member guides the transfer medium toward the image carrying member while supporting a side of the transfer medium on which the developer image is not transferred, and the guide member covers at least a part of the image carrying member.

According to another exemplary aspect of the invention, an image forming apparatus including a casing with a transfer device capable of transferring a developer image from an image carrying member to a transfer medium, and an attachable/detachable process cartridge is provided. In various exemplary embodiments, the process cartridge includes a frame with a first side wall, a second side wall, a bottom wall and a front wall, an image carrying member, a guide member, a first opening in the bottom wall and a second opening in the bottom wall. The image carrying member is supported by and extends between the first side wall and the second side wall in a manner that permits the image carrying member to rotate, and the image carrying member projects, at least in part, beyond a bottom surface of the bottom wall. The guide member extends between the first side wall and the second side wall and forms part of the bottom wall. The first opening in the bottom wall extends from the first side wall to the second side wall and is provided between the front wall and the guide member. The second opening in the bottom wall extends from the first side wall to the second side wall and is provided between the guide member and the image carrying member.

These and other optional features and possible advantages of various aspects of this invention are described in, or are apparent from, the following detailed description of exemplary embodiments of systems and methods which implement this invention.

BRIEF DESCRIPTION OF THE DRAWINGS

Various exemplary embodiments of the invention will be described in detail with reference to the following figures, wherein.

DETAILED DESCRIPTION OF EXEMPLARY EMBODIMENTS

Figure 1:
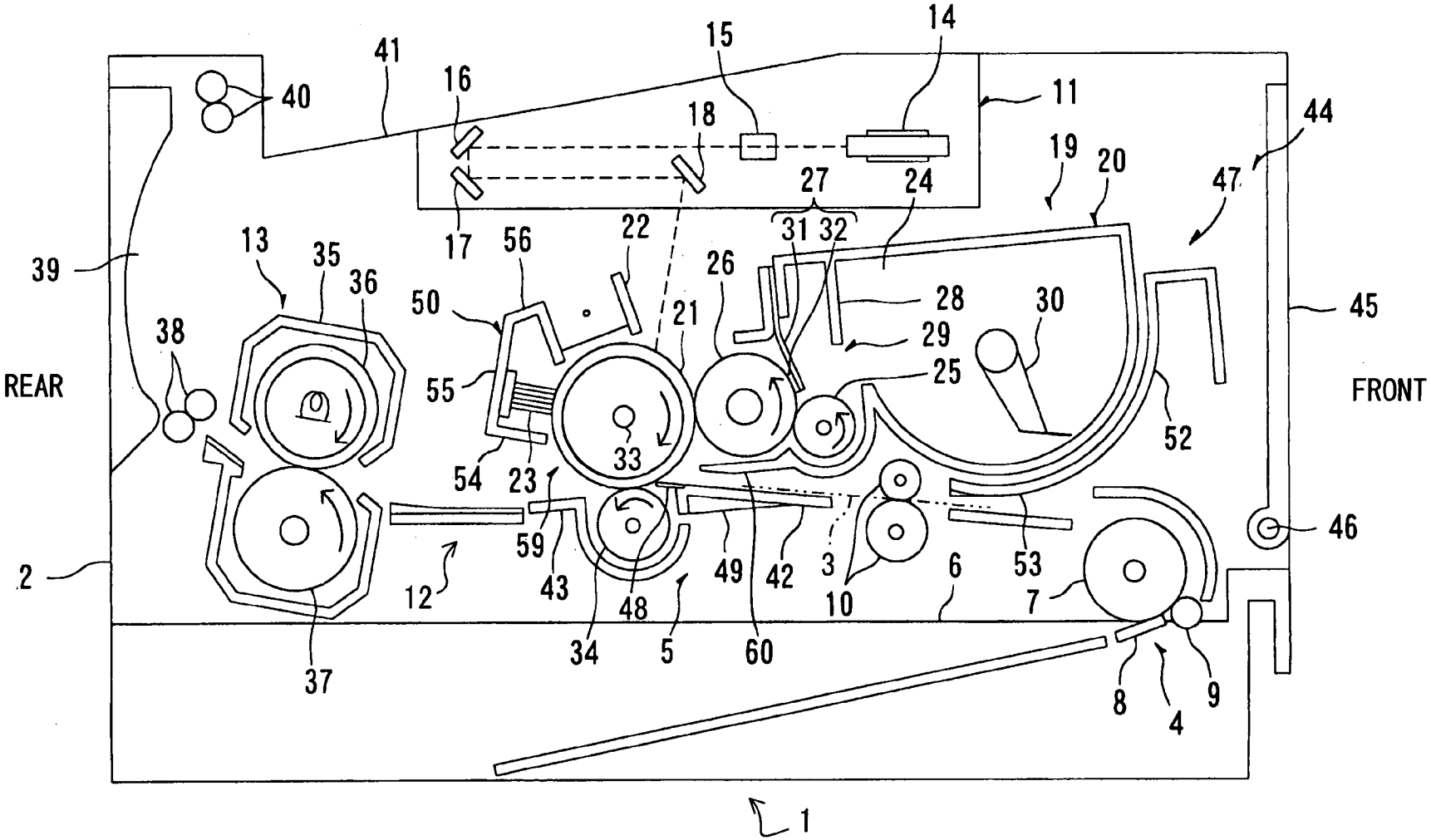
FIG. 1 is a cross sectional view of a portion of an exemplary laser printer employing one or more aspects of the invention in a state where a front cover is closed.

Throughout the following description, numerous specific concepts and structures are set forth in order to provide a thorough understanding of the invention. The invention can be practiced without utilizing all of these specific concepts and structures. In other instances, well known elements have not been shown or described in detail, so that emphasis can be focused on the invention.

In various exemplary embodiments, a process cartridge may be removably installed in image forming apparatus that includes a transfer device for transferring developer images onto transfer media. The process cartridge may include an image carrying member that is capable of carrying a developer image. The image carrying member is disposed to face the transfer device when the process cartridge is removably positioned in the image forming apparatus. A guide member may be disposed on the process cartridge upstream (in a feeding direction of a transfer medium) of a position where the transfer device and the image carrying member face each other and the length of the guide member may extend along a direction of extension of the length of the image carrying member. The guide member may guide the transfer medium toward the image carrying member while supporting a side of the transfer medium opposite from a side on which the developer image is transferred. The guide member may be further positioned to cover a part of the image carrying member such that the covered part of the image carrying member does not face.

In various exemplary embodiments, the guide member that guides the transfer medium may be provided on the process cartridge and may cover a part of the image carrying member. Therefore, damage to the image carrying member, which can occur, for example, while the process cartridge is being attached/detached from the image forming apparatus, may be reduced, and preferably prevented, by the guide member. Such a guide member is generally less costly and has a less complicated structure for reducing, and preferably preventing, damage to the image carrying member, than the shutter structure discussed above. The transfer device may be provided in the image forming apparatus, which accommodates such a process cartridge and such an arrangement allows for the manufacture of smaller sized process cartridges. By allowing the manufacture of a smaller sized process cartridge, a smaller sized image forming apparatus, which can attachably/detachably accommodate the process cartridge may also be manufactured.

In some exemplary embodiments, at least a part of a guide member of a process cartridge is positioned on an image-carrying-member side of a plane that is tangential to a point on an image carrying member where the image carrying member contacts a transfer roller in an image forming apparatus when the process cartridge is removably installed in the image forming apparatus.

By employing such a structure, the guide member may be provided on the process cartridge rather than in the image forming apparatus and there are many advantages to providing the guide member on the process cartridge rather than in the image forming apparatus. For example, the process cartridge can be installed in or removed from the image forming apparatus without needing to avoid the guide member situated in the image forming apparatus. Thus, because it is not necessary to allocate space within the image forming apparatus to help avoid contact between the process cartridge and the guide member of the image forming apparatus during attachment/detachment of the process cartridge when the guide member is provided on the process cartridge, the amount of space in the image forming apparatus allocated for attachment/detachment of the process cartridge may be reduced.

Providing the guide member on the process cartridge is also advantageous because when a guide member is provided in an image forming apparatus, and at least a part of a guide member is positioned on an image-carrying-member side of a plane that is tangential to a point on an image carrying member where the image carrying member contacts a transfer roller in the image forming apparatus, when the process cartridge is installed/removed in/from the image forming apparatus, the process cartridge does not need to be guided into/out of the image forming apparatus in a manner that will avoid, as much as possible, the guide member of the image forming apparatus in order to reduce, and preferably prevent, damage to the image carrying member. That is, in embodiments where the guide member is provided on the process cartridge, the guide member does not contact the image carrying member during installation/removal of the process cartridge, and thus damage to the image carrying member by the guide member can be reduced, and preferably avoided. Further, in some embodiments, as the guide member may be positioned on an image carrying member side of a plane that is tangential to a point on an image carrying member where the image carrying member contacts a transfer roller in an image forming apparatus when the process cartridge is installed in the image forming apparatus, a transfer medium may be smoothly guided toward the contact point.

In various exemplary embodiments, when a process cartridge is removably installed in an image forming apparatus, a guide member provided on the process cartridge may guide a transfer medium such that a leading edge of the transfer medium is guided so as to contact an image carrying member of the process cartridge upstream (in a direction that a transfer medium is guided) of a contact position between and the image carrying member and a transfer device in the image forming apparatus.

By employing such a structure, the leading end of the transfer medium (already in contact with a surface of the image carrying member) may be smoothly guided to the contact position between the image carrying member and the transfer device as the image carrying member rotates. In addition, spatter of developer due to electrical discharge can be reduced, and preferably avoided, thereby promoting favorable developer image transfer.

In various exemplary embodiments, a process cartridge may include frame side plates disposed, so as to face each other, at end portions of an image carrying member provided in the process cartridge. The frame side plates may support ends of the image carrying member. A guide member may be formed in a plate-like shape so as to extend between the frame side plates in a longitudinal direction along the length of the image carrying member. By employing such a structure, the guide member can be formed simply, while extending along the image carrying member in a longitudinal direction and covering at least part of the image carrying member.

In various exemplary embodiments, a guide member of a process cartridge may be provided with one or more ribs that help provide rigidity to the guide member. By employing such a structure, the enhanced rigidity of the guide member at least reduces, and preferably prevents, deformation which can cause the guide member to contract the image carrying member. Accordingly, damage to the image carrying member caused by such contact may be reduced, and preferably prevented.

In various exemplary embodiments, a guide member of a process cartridge may be provided with a flexible film member that extends from the guide member and toward an image carrying member of the process cartridge. The flexible member may be provided at a downstream (in a direction that a transfer medium is guided) end of the guide member. By employing such a structure, the film member may shorten the distance between the guide member and the image carrying member, so that feeding accuracy of the transfer medium may be improved. Even if the film member, which is flexible, contacts the image carrying member, the possibility of damage to the image carrying member is low. Accordingly, the film member may be positioned near the image carrying member without causing damage to the image carrying member.

In various exemplary embodiments, a process cartridge may include a developing cartridge that supplies a developer to an image carrying member provided on the process cartridge. The developing cartridge may be removably installed in the process cartridge. By employing such a structure, when the developing cartridge is removed from the process cartridge, exposure of the image carrying member may be reduced because at least part of the image carrying member is covered by the guide member. Thus, damage to the image carrying member may be reduced, and preferably prevented.

In various exemplary embodiments, a developing cartridge may have a guide surface that guides a transfer medium from a side of the transfer medium on which a developer image is transferred. By employing such a structure, the transfer medium can be fed with high accuracy.

In various exemplary embodiments, an image forming apparatus may include a transfer device that transfers a developer image onto a transfer medium, and a process cartridge. By providing the transfer device on the image forming apparatus, the image forming apparatus may include a smaller-sized process cartridge. Therefore, the image forming apparatus may also, in turn, be reduced in size.

In various exemplary embodiments, an image forming apparatus may include a path for removably installing a process cartridge in the image forming apparatus. The path may be provided substantially parallel to a feeding direction of a transfer medium in the image forming apparatus. By employing such a structure, when the process cartridge is removably installed in the image forming apparatus, the process cartridge may be installed and removed in a direction substantially parallel to the feeding direction of the transfer medium. Thus, the space allocated for removably installing the process cartridge in the image forming apparatus may be reduced. Therefore, the image forming apparatus may also, in turn, be reduced in size.

In various exemplary embodiments, an image forming apparatus may further include a casing that accommodates a transfer device and a process cartridge, an opening that communicates with the path and is formed in the casing on a front side of the image forming apparatus, and a cover that opens or closes the opening. By employing such a structure, the process cartridge may be removably installed in the image forming apparatus from a front side thereof. Ease of installing or removing the process cartridge may be improved by providing front access.

As shown in FIG. 1, an exemplary laser printer 1 is provided with a main casing 2 in which a feeder section 4 for feeding sheets 3 and an image forming section 5 for forming images on the fed sheets 3 are disposed.

Figure 3:
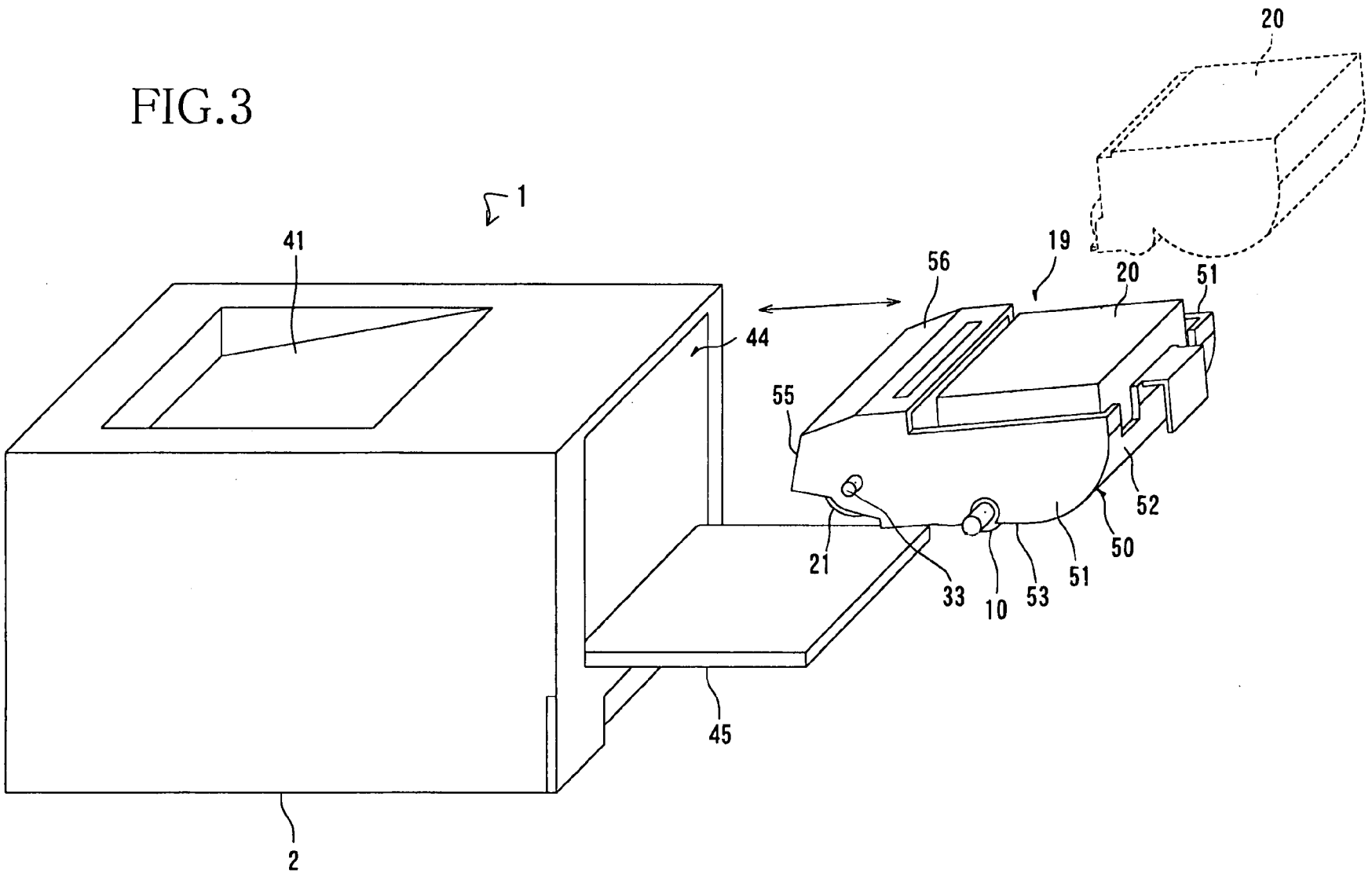
FIG. 3 is a perspective view of the laser printer shown in FIG. 1 in a state where an exemplary process cartridge is removed from the printer.

The main casing 2 may have, for example, a substantially box-like shape, as best seen in FIG. 3. An opening 44 for removably installing a process cartridge 19 (described below) in the laser printer 1 is formed on a front sidewall of the main casing 2. A front cover 45 for opening and closing the opening 44 is provided on the front sidewall of the main casing 2. A lower end of the front cover 45 is pivotally attached to the casing 2 by a hinge 46. When the front cover 45 is closed by pivoting the front cover 45 about the hinge 46, the opening 44 is closed. As the front cover 45 is opened by pivoting the front cover 45 about the hinge 46, the opening 44 is opened, so as to make it possible to install or remove of the process cartridge 19 into or from the main casing 2.

An installation/removal path 47 for removably setting the process cartridge 19 in the main casing 2 is provided inside the main casing 2. The installation/removal path 47 is substantially parallel to a feeding direction of the sheet 3 (i.e., sheet feeding direction) and communicates with the opening 44.

With the process cartridge 19 set in the main casing 2, a side where the front cover 45 is disposed is defined as a front side of the laser printer 1 or the process cartridge 19. The opposite side to the front side (a side where a fixing unit 13 is disposed) is defined as a rear side of the laser printer 1 or the process cartridge 19.

The feeder section 4 includes a sheet supply tray 6 removably installed in a bottom of the main casing 2, a pick-up roller 7 and a separation pad 8 disposed at an upper portion of the front side of the sheet supply tray 6, a sheet powder removing roller 9 disposed downstream of the separation pad 8 in the sheet feeding direction, and register rollers 10 disposed downstream of the sheet powder removing roller 9 in the sheet feeding direction.

The sheet supply tray 6 is capable of mounting thereon a stack of the sheets 3. The pick-up roller 7 and the separation pad 8 are provided so as to face each other. The separation pad 8 is pressed against the pick-up roller 7 by a spring (not shown) disposed on an underside of the pad 8. The sheet powder removing roller 9 is disposed downstream of the separation pad 8 in the sheet feeding direction, so as to face the pick-up roller 7.

The register rollers 10 include a pair of rollers. One of the register rollers 10 disposed on the upper side (upper-side register roller) is provided in the process cartridge 19. The other one of the register rollers 10 disposed on the lower side (lower side register roller) is provided in the main casing 2. With the process cartridge 19 set in the main casing 2, the lower-side register roller 10 provided in the main casing 2 faces and contacts the upper-side register roller 10, which is provided in the process cartridge 19, vertically from below. As the lower-side register roller 10 is driven during the sheet feeding, the upper-side register roller 10 follows the rotation of the lower-side register roller 10.

An uppermost sheet 3 on the sheet supply tray 6 is pressed by the pick-up roller 7. By the rotation of the pick-up roller 7, the uppermost sheet 3 is nipped between the pick-up roller 7 and the separation pad 8 and separated from the remaining sheets 3. Sheet powders or fibers on the sheet 3 are removed by the sheet powder removing roller 9. Then, the sheet 3 is fed to the register rollers 10, where the sheet 3 is registered and/or skew of the sheet 3 is corrected. Thereafter, the sheet 3 is fed to a transfer position in the image forming section 5. The transfer position is a position between a photosensitive drum 21 and a transfer roller 34 where a toner image on the photosensitive drum 21 is transferred onto the sheet 3.

The image forming section 5 includes a scanner unit 11, a process unit 12, and a fixing unit 13.

The scanner unit 11 is provided in an upper portion of the main casing 2. The scanner unit 11 includes a laser emitting portion (not shown), a polygon mirror 14 that is driven so as to spin, a lens 15, and reflecting mirrors 16, 17, 18. A laser beam emitted from the laser emitting portion based on image data passes through or reflects off the polygon mirror 14, the lens 15, the reflecting mirrors 16, 17, 18 in this order, to irradiate with the laser beam a surface of the photosensitive drum 21 of the process cartridge 19 at a high speed.

The process unit 12 includes the process cartridge 19, removably installed in the main casing 2, and the transfer roller 34, as a transfer device, provided in the main casing 2. The process cartridge 19 is installed in the main casing 2 below the scanner unit 11. The process cartridge 19 includes a frame 50 and a developer cartridge 20, the photosensitive drum 21, as an image carrying member, a scorotron charger 22, and a cleaning brush 23. The developer cartridge 20, the photosensitive drum 21, the scorotron charger 22 and the cleaning brush 23 are disposed in the frame 50. The developer cartridge 20 is attachably/detachably disposed in the frame 50.

Figure 2:
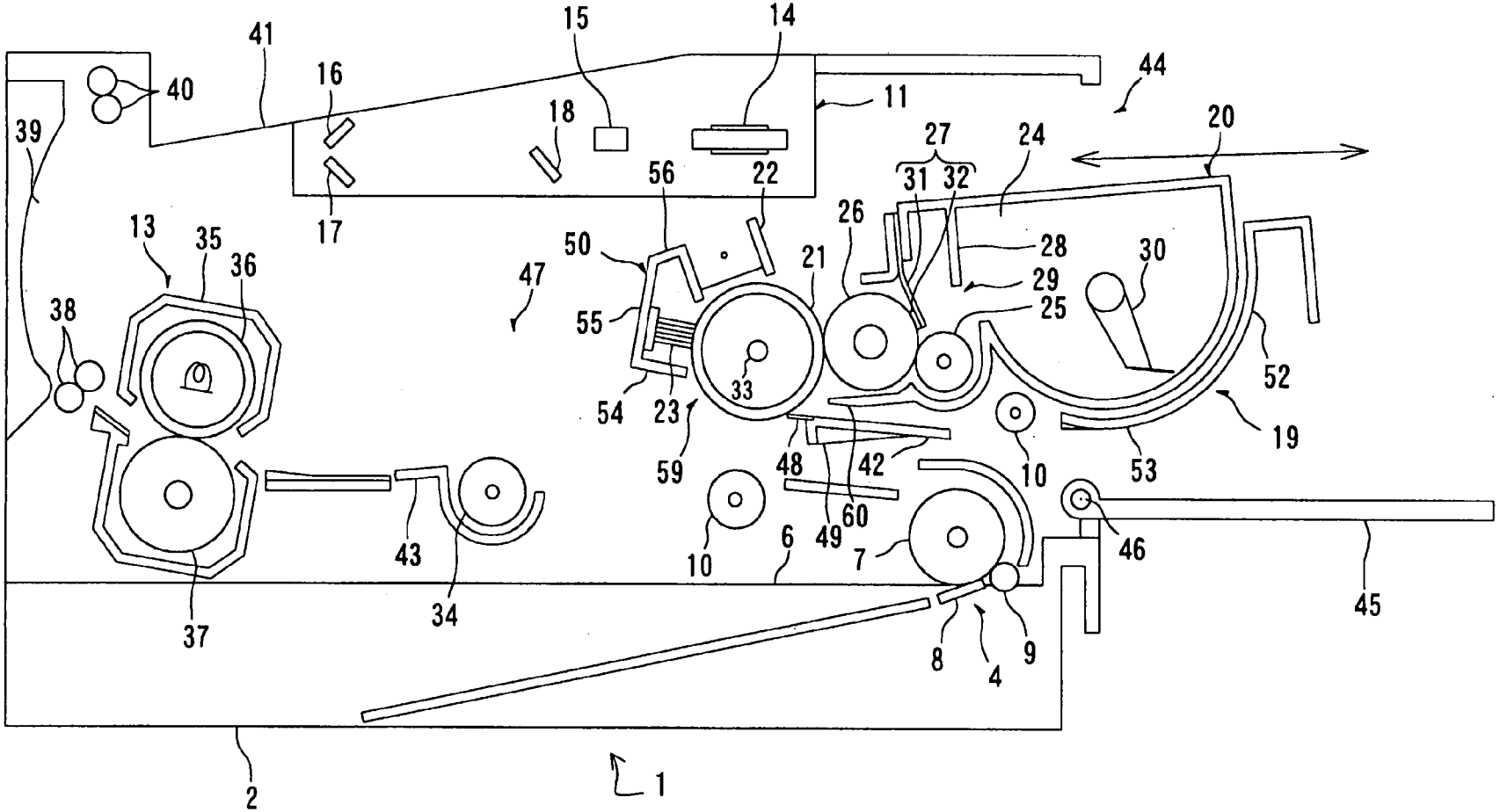
FIG. 2 is a cross sectional view of a portion of the laser printer shown in FIG. 1 in a state where the front cover is open.

As shown in FIGS. 2 and 3, the frame 50 includes a pair of side walls 51 disposed in confrontation with each other at a predetermined distance, a front wall 52 connected to front ends of the side walls 51, a front bottom wall 53 connected to lower ends of the side walls 51 at a front portion thereof, a rear bottom wall 54 connected to lower ends of the side walls 51 at a rear portion thereof, a rear wall 55 connected to rear ends of the side walls 51, and a top wall 56 connected to upper ends of the side walls 51 at a rear portion thereof. The walls 51–56 are integrally formed. The frame 50 is formed substantially in a box shape with a front side of the frame 50 open upward and sideward. The developer cartridge 20 is removably installed in the upward-open portion of the frame 50.

The front wall 52 and the front bottom wall 53 together have a substantially arc-shaped cross section. The front bottom wall 53 and the rear bottom wall 54 face each other in the frontward and rearward direction and have an open area 59 between them. A part of the photosensitive drum 21 is exposed from the open area 59.

As shown in FIG. 1, the developer cartridge 20 includes a toner chamber 24, a supply roller 25, a developer roller 26, and a layer thickness regulating blade 27.

The toner chamber 24 is formed as an interior space in a front portion of the developer cartridge 20 that is divided by a partition wall 28. Formed below the partition wall 28 is a port 29 that allows the communication between the front portion and rear portion of the developer cartridge 20.

The toner chamber 24 contains as a developing agent, for example, a positively chargeable non-magnetic single component toner. The toner may be, for example, polymerized toner that is obtained by copolymerizing polymerizable monomers using a known polymerization method, such as, for example, a suspension polymerization method. The polymerizable monomers may be styrene-based monomers, such as styrene, and acrylic-based monomers, such as acrylic acid, alkyl (C1–C4) acrylate, and/or alkyl (C1–C4) methacrylate. Polymerized toner particles are generally spherical in shape, having excellent fluidity, permitting high-quality image formation.

Toner may be mixed with a coloring material, such as carbon black, and wax, as well as an external additive, such as silica, to improve the fluidity of the toner. Average toner particle sizes may be about 6 μm to about 10 μm.

An agitator 30 is disposed in the toner chamber 24. The toner contained in the toner chamber 24 is agitated by the agitator 30 and supplied to the supply roller 25 through the port 29.

The supply roller 25 is rotatably supported in the developer cartridge 20 behind the port 29. The supply roller 25 may include a metal roller shaft covered by a roller portion formed of conductive foam. The supply roller 25 is driven by a drive force input from a motor (not shown), so as to rotate in a counterclockwise direction, as indicated by the arrow in FIG. 1.

The developer roller 26 is rotatably supported in the developer cartridge 20, such that the supply roller 25 and the developer roller 26 contact each other so as to apply pressure to each other. The developer roller 26 includes a metal roller shaft covered by a roller portion formed of, for example, a conductive elastic material. In some embodiments, the roller portion of the developer roller 26 may be formed of conductive urethane rubber or silicone rubber including fine carbon particles. A surface of the roller portion of the developer roller 26 may be coated with urethane rubber or silicone rubber including fluorine. A development bias is applied to the developer roller 26 during development. The developer roller 26 is driven by the drive force input from the motor (not shown), so as to rotate in the same direction (counterclockwise) as the supply roller 25, as indicated by the arrow in FIG. 1.

The layer thickness regulating blade 27 includes a blade body 31 formed, for example, of a flexible metal plate, and a pressing portion 32 formed, for example, of insulating silicone rubber having a substantially semicircular shape in cross section. The layer thickness regulating blade 27 is supported by the developer cartridge 20 near the developer roller 26. The pressing portion 32 presses the surface of the developer roller 26 with the elasticity/flexibility of the blade body 31.

The toner supplied through the port 29 is conveyed to the developer roller 26 by the rotation of the supply roller 25. When the toner is supplied from the supply roller 25 to the developer roller 26, the toner is positively charged by the friction formed between them. As the developer roller 26 rotates, the toner supplied by the supply roller 25 to the developer roller 26 moves between the developer roller 26 and the pressing portion 32 of the layer thickness regulating blade 27, where it is formed into a thin toner layer, with a substantially uniform thickness, on the developer roller 26.

The photosensitive drum 21 is disposed behind the developer cartridge 20 to face the developer roller 26. The photosensitive drum 21 is of a substantially cylindrical shape and is electrically grounded. The photosensitive drum 21 is supported by the side walls 51 of the frame 50 so as to rotate on a drum shaft 33, which is disposed along an axis of the drum 21, in a clockwise direction, as indicated by the arrow in FIG. 1. An outermost surface of the photosensitive drum 21 is formed of a positively chargeable photosensitive layer. With the photosensitive drum 21 being supported by the side walls 51, a lower portion of the photosensitive drum 21 is exposed from the open area 59, which is defined along an axial direction of the photosensitive drum 21 between the front bottom wall 53 and the rear bottom wall 54.

As shown in FIG. 3, the drum shaft 33 protrudes outwardly from the side walls 51.

As shown in FIGS. 1 and 2, the scorotron charger 22 is supported by the top wall 56 above the photosensitive drum 21 with a predetermined distance therebetween, to prevent the scorotron charger 22 from contacting the photosensitive drum 21. The scorotron charger 22 may be, for example, a positively charging scorotron charger that generates corona discharge from a tungsten wire. The scorotron charger 22 uniformly and positively charges the surface of the photosensitive drum 21.

The cleaning brush 23 is supported by the rear wall 55 behind the photosensitive drum 21. The cleaning brush 23 is disposed so as to confront the photosensitive drum 21 and such that it contacts the surface of the drum 21.

The transfer roller 34 is provided in the main casing 2. With the process cartridge 19 is set in the main casing 2, the transfer roller 34 vertically faces and contacts the photosensitive drum 21. The transfer roller 34 is disposed so as to nip a sheet 3 between the transfer roller 34 and the photosensitive drum 21. Because the transfer roller 34 is provided in the main casing 2, a smaller sized process cartridge 19 can be manufactured. The transfer roller 34 includes, for example, a metal roller shaft covered by a roller portion formed of conductive rubber.

A transfer bias is applied to the transfer roller 34 during transfer of the toner onto the sheet 3. The transfer roller 34 is driven by the drive force input from the motor (not shown), so as to rotate in the counterclockwise direction, as shown by the arrow in FIG. 1.

While the photosensitive drum 21 rotates, the surface of the photosensitive drum 21 is uniformly and positively charged by the scorotron charger 22. Thereafter, the surface of the photosensitive drum 21 is selectively exposed to the laser beam that is emitted from the scanner unit 11 and which scans across the surface of the drum 21 at a high speed. An electrostatic latent image corresponding to an image to be formed on the sheet 3, is thereby formed on the surface of the photosensitive drum 21.

Thereafter, as the positively charged toner, which is being carried on the developer roller 26, is brought into contact with the photosensitive drum 21 based on the rotation of the developer roller 26, the toner is supplied to the electrostatic latent image on the surface of the photosensitive drum 21. As a result, the parts of the photosensitive drum 21 that were selectively exposed to the laser beam and thus have a lower potential level than the remaining parts (i.e., non-exposed parts) of the photosensitive drum 21 surface that are uniformly positively charged. Thus, a reverse image is developed on the surface of the photosensitive drum when the electrostatic latent image on the photosensitive drum 21 is made visible by the attraction between the positively charged toner and the lower potential regions (i.e., regions exposed by the laser beam) of the photosensitive drum.

When the sheet 3, which is fed by the register rollers 10, passes through the transfer position between the photosensitive drum 21 and the transfer roller 34, the toner image carried on the surface of the photosensitive drum 21 is transferred on the sheet 3 by the application of the transfer bias to the transfer roller 34.

Thereafter, the sheet 3 having the toner image transferred thereon is fed to the fixing unit 13.

The toner which remains on the photosensitive drum 21 after the toner image is transferred, is collected by the developer roller 26. Sheet powders or fibers attached to the photosensitive drum 21 after the toner image transfer are collected by the cleaning brush 23.

The fixing unit 13 is disposed behind the process cartridge 19. The fixing unit 13 includes a unit frame 35, a heat roller 36 and a pressure roller 37, and feed rollers 38. The heat roller 36 and the pressure roller 37 are disposed in the unit frame 35.

The heat roller 36 includes, for example, a metal tube accommodating therein a halogen lamp for heat application. The heat roller 36 is driven by the drive force input from the motor (not shown), so as to rotate in the clockwise direction, as indicated by the arrow in FIG. 1.

The pressure roller 37 is disposed below the heat roller 36, so as to press the heat roller 36. The pressure roller 37 includes, for example, a metal roller shaft covered by a roller portion formed of rubber material. The pressure roller 37 is rotated by the rotation of the heat roller 36.

The feed rollers 38 include a pair of rollers. The feed rollers 38 are disposed downstream of the heat roller 36 and the pressure roller 37 in the sheet feeding direction, behind the rollers 36, 37.

In the fixing unit 13, the toner transferred at the transfer position onto the sheet 3 is thermally fixed to the sheet 3 while the sheet 3 passes through between the heat roller 36 and the pressure roller 37. The sheet 3 having the toner fixed thereon is guided by the feed rollers 38 to a discharge path 39 that is disposed behind the feed rollers 38 so as to extend upwardly toward an upper face of the main casing 2. Then, the sheet 3 that is conveyed to the discharge path 39 is discharged by the discharge rollers 40, which are disposed at an upper side of the discharge path 39, onto a discharge tray 41 formed on the upper face of the main casing 2.

The laser printer 1 is provided with a front chute 42 and a rear chute 43, as guide members, so as to interpose the transfer roller 34 between them. The front chute 42 guides the sheet 3 toward the transfer roller 34 while supporting an underside of the sheet 3 on which the toner image is not transferred. The rear chute 43, which is disposed behind the front chute 42, guides the sheet 3 toward the fixing unit 13 while supporting the underside of the sheet 3 that passed the transfer roller 34.

The rear chute 43 is disposed in the main casing 2. The rear chute 43 is integrally formed with a substantially U-shaped cover portion that covers a lower portion of the transfer roller 34 and a guide portion that extends rearward from a rear end of the cover portion.

Figure 4:
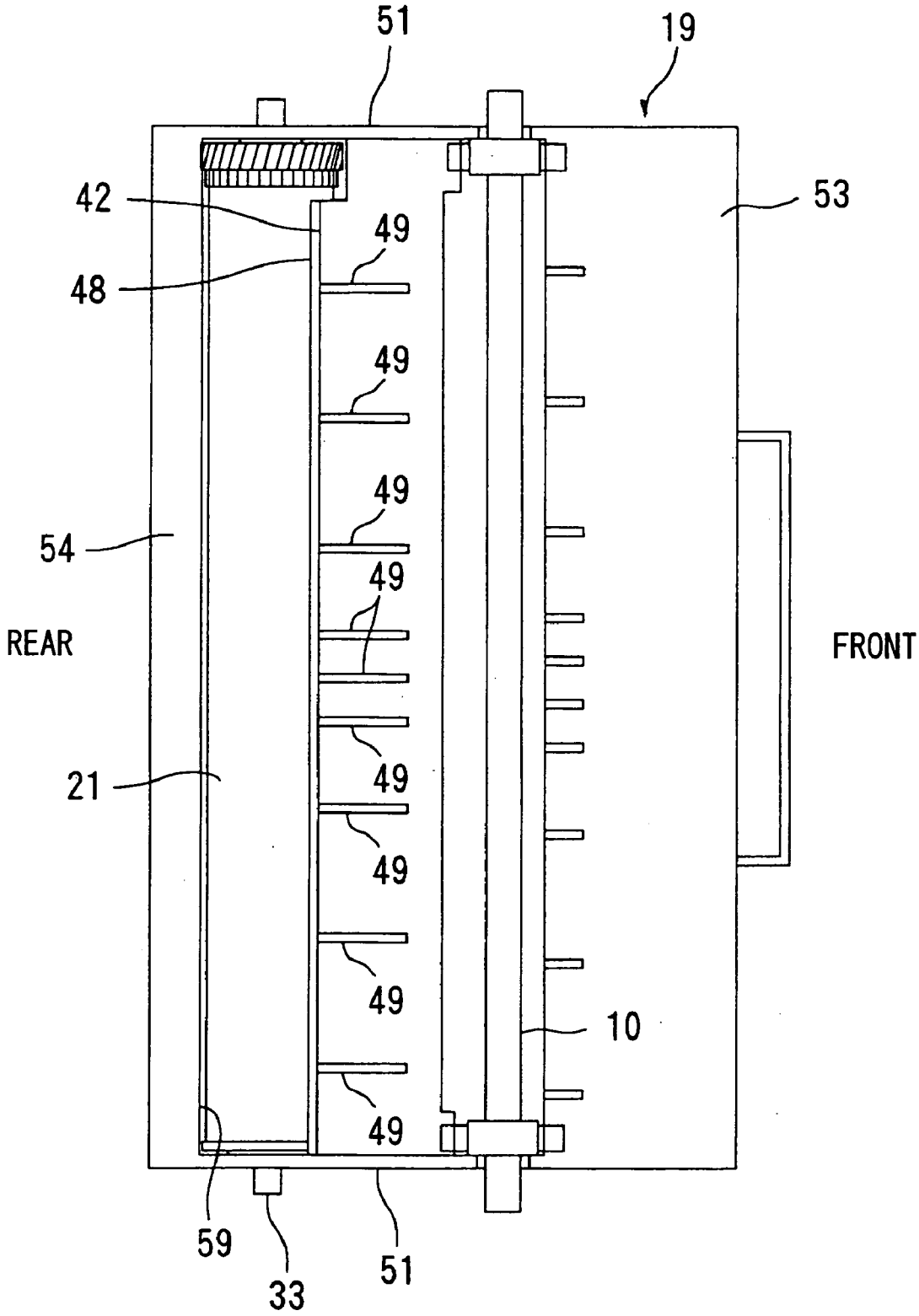
FIG. 4 is a bottom view of the process cartridge shown in FIG. 3.

As shown in FIG. 4, the front chute 42 is provided between the front bottom wall 53 of the frame 50 and the photosensitive drum 21, at a predetermined distance from the photosensitive drum 21. The front chute 42 has, for example, a substantially rectangular shape that extends between the side walls 51 of the frame 50 along the axial direction of the photosensitive drum 21. The front chute 42 is disposed parallel to the axis of the photosensitive drum 21 at a position upstream of a nip portion between the photosensitive drum 21 and the transfer roller 34 in the sheet feeding direction, so as to face the surface of the photosensitive drum 21 and to cover a part of a lower front portion of the photosensitive drum 21 along the axial direction of the drum 21. With the process cartridge 19 removed from the main casing 2, the front chute 42 covers a part of the surface of the photosensitive drum 21. Thus, damage to the photosensitive drum 21 can be reduced, and preferably prevented, without employing a shutter, which can lead increased manufacturing costs.

With the process cartridge 19 removed from the main casing 2, as the developer cartridge 20 is removed from the frame 50, as shown by broken lines in FIG. 3, the amount of exposure of the photosensitive drum 21 is increased. However, the front chute 42 covers the lower front part of the photosensitive drum 21, so that the exposure of the photosensitive drum 21 can be reduced when the developer cartridge 20 is removed from the frame 50. Consequently, damage to the photosensitive drum 21 is reduced, and preferably prevented.

As shown in FIG. 2, the front chute 42 is provided with a flexible film member 48 formed of resin film on a rear end of the front chute 42 (downstream end of the chute 42 in the sheet feeding direction). The film member 48 has a substantially rectangular shape. The front end of the film member 48 is supported by the front chute 42 across the width thereof along the axial direction of the photosensitive drum 21, and extends toward the photosensitive drum 21. The rear end of the film member 48 is positioned on the photosensitive drum 21 side of a plane that is tangential to a point on the photosensitive drum 21 where the photosensitive drum 21 contacts the transfer roller 34, when the process cartridge 19 is positioned in the laser printer 1. Therefore, the distance between the front chute 42 and the photosensitive drum 21 is shortened by the extending film member 48. Further, the film member 48 guides a leading end of the sheet 3 to a position upstream of the nip portion between the photosensitive drum 21 and the transfer roller 34. That is, the front chute 42 that may be provided with the film member 48 is disposed so as to guide the leading end of the sheet 3 into contact with the photosensitive drum 21 at a position upstream of the nip portion where the photosensitive drum 21 and the transfer roller 34 are in contact.

By rotation of the photosensitive drum 21, the leading end of the sheet 3, which is in contact with the surface of the photosensitive drum 21, is smoothly guided to the nip portion between the photosensitive drum 21 and the transfer roller 34, resulting in an improvement in sheet feeding accuracy. Also, as the leading end of the sheet 3 contacts the surface of the photosensitive drum 21 at an upstream side of the nip portion between the photosensitive drum 21 and the transfer roller 34, electrical discharge between the sheet 3 and the photosensitive drum 21 can be prevented. Thus, spatter of the toner due to electrical discharge can be reduced, and preferably avoided, leading to favorable toner image transfer.

Even if the flexible film member 48 flexes and contacts the photosensitive drum 21, the film member 48 is not likely to damage the photosensitive drum 21, due to its flexibility. Therefore, the film member 48 can be disposed near the photosensitive drum 21, while not causing damage to the photosensitive drum 21.

The front chute 42 is provided in the process cartridge 19. Therefore, even when the rear end of the film member 48 is positioned on the photosensitive drum 21 side of a plane that is tangential to a point on the photosensitive drum 21 where the photosensitive drum 21 contacts the transfer roller 34, when the process cartridge 19 is positioned in the laser printer 1, the process cartridge 19 does not have to bypass the front chute 42 when set in or removed from the main casing 2, in contrast with an apparatus in which the front chute 42 is provided in the main casing 2, rather than on the process cartridge 19, to be configured with respect to the photosensitive drum 21, as discussed above. Thus, the process cartridge 19 can be moved in a substantially straight manner along the installation/removal path 47.

More specifically, in the case where the front chute 42 is provided in the main casing 2, when the process cartridge 19 is set in the casing 2 to make the photosensitive drum 21 face the transfer roller 34, the process cartridge 19 has to bypass the film member 48 of the front chute 42, so as to make the photosensitive drum 21 go over the film member 48 when brought into confrontation with the transfer roller 34. Also, in the case where the front chute 42 is provided in the main casing 2, the process cartridge 19 has to bypass the film member 48 of the front chute 42, from the position where the photosensitive drum 21 faces the transfer roller 34, when the process cartridge is being removed from the main casing 2.

In contrast to an image forming apparatus in which a front chute 42 is provided on the main body casing, in an exemplary embodiment of an image forming apparatus in which the front chute 42 is provided in the process cartridge 19, as shown, for example, in FIG. 1, while attaching/detaching the process cartridge 19 to/from the image forming apparatus, the process cartridge 19 does not have to bypass the film member 48. That is, in an exemplary embodiment of an image forming apparatus in which the front chute 42 is provided on the process cartridge 19, the process cartridge 19 may be moved relative to the main casing 2 in a substantially straight direction along the installation/removal path 47, which is substantially parallel to the sheet feeding direction. Thus, the height of the installation/removal path 47 necessary to removably install the process cartridge 19 in the main casing 2 can be about the same height as the process cartridge 19. Thus, a smaller sized installation/removal path 47 can be provided.

Further, in an embodiment where the front chute 42 is provided on the process cartridge 19, when the process cartridge 19 is removably installed in the main casing 2, the photosensitive drum 21 does not contact the front chute 42, so damage to the photosensitive drum 21 by the front chute 42 can be prevented. Consequently, the laser printer 1 can be reduced in size based on the reduction in size of the process cartridge 19, while preventing the photosensitive drum 21 from being damaged by the front chute 42.

As shown in FIG. 4, in the exemplary embodiment, a plurality of ribs 49 are aligned on a reverse or undersurface of the front chute 42 along the axial direction of the photosensitive drum 21. The ribs 49 help provide rigidity to the front chute 42. Each rib 49 may be formed in a substantially triangular shape, such that the base of the triangular rib 49 is disposed on the downstream side and the vertex is disposed on the upstream side in the sheet feeding direction, as shown in FIG. 1. By employing the ribs 49, the rigidity of the front chute 42 is increased and deformation of the front chute 42, which can result in contact between the front chute 42 and the photosensitive drum, can be avoided. Thus, the photosensitive drum 21 is further prevented from being damaged by the front chute 42.

In various exemplary embodiments, an underside of the sheet 3 is supported by the front chute 42. The upper side of the sheet 3, where the toner image is transferred, is guided by a rear end portion 60 that is provided on the lower side of the developer cartridge 20. More specifically, the rear end portion 60 on the lower side of the developer cartridge 20 is formed substantially parallel to the front chute 42 and such that there is some distance between them in the vertical direction. The rear end portion 60 is formed as a guide surface that guides the sheet 3 from the upper side thereof. Thus, the sheet 3 can be fed properly to the nip portion between the photosensitive drum 21 and the transfer roller 34.

In the laser printer 1, the opening 44 for removably installing the process cartridge 19 in the laser printer 1 is formed on a front sidewall of the main casing 2. Therefore, the process cartridge 19 can be removably installed in the main casing 2 from the front side of the laser printer 1. Thus, ease of installation or removal of the process cartridge 19 can be improved by the front access.

While this invention has been described in conjunction with the exemplary embodiments outlined above, various alternatives, modifications, variations, improvements and/or substantial equivalents, whether known or that are or may be presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the invention is intended to embrace all known or later developed alternatives, modifications, variations, improvements and/or substantial equivalents.

What is claimed is:

1. A process cartridge, comprising:

a frame including a first side wall, a second side wall and a bottom wall;

an image carrying member provided in a rear portion of the process cartridge, the image carrying member being supported by and extending between the first side wall and the second side wall in a manner that permits the image carrying member to rotate, and the image carrying member projecting, at least in part, beyond a bottom surface of the bottom wall;

a guide member extending between the first side wall and the second side wall, the guide member forming part of the bottom wall;

a first opening in the bottom wall extending from the first side wall to the second side wall and provided between a front portion of the bottom wall and the guide member; and a second opening in the bottom wall extending from the first side wall to the second side wall and provided between the guide member and the image carrying member.

2. The process cartridge of claim 1, wherein a bottom surface of the guide member is provided with at least one rib.

3. The process cartridge of claim 2, wherein at least one of the at least one rib extends along the bottom surface of the guide member in a direction transverse to a length of the image carrying member.

4. The process cartridge of claim 3, wherein the at least one of the at least one rib includes a front end and a back end, the back end extending further away from the bottom surface of the guide member than the front end.

5. The process cartridge of claim 2, wherein at least one of the at least one rib has a triangular profile, when viewed from either of the first and second side walls.

6. The process cartridge of claim 5, wherein the triangular profile includes a base at a back end of the at least one rib and a vertex at a front end of the at least one rib.

7. The process cartridge of claim 1, further comprising a detachable developer cartridge, the detachable developer cartridge including at least a developer roller and a toner.

8. The process cartridge of claim 1, wherein the guide member is positioned so that at least a part of the guide member is on an image carrying member side of a plane that is tangential to a point on the image carrying member where the image carrying member contacts a transfer roller in an image forming apparatus, when the process cartridge is installed in the image forming apparatus.

9. The process cartridge of claim 1, wherein the guide member is provided with a flexible film member extending away from the guide member and toward the image carrying member.

10. The process cartridge of claim 9, wherein the flexible film member covers, at least in part, the second opening.

11. The process cartridge of claim 10, wherein the flexible film is positioned on an image carrying member side of a plane that is tangential to a point on the image carrying member where the image carrying member contacts a transfer roller in an image forming apparatus, when the process cartridge is installed in the image forming apparatus.

12. The process cartridge of claim 9, wherein the flexible film is a substantially rectangular resin film.

13. A process cartridge capable of being removably installed in an image forming apparatus including a transfer device that transfers a developer image from an image carrying member to a transfer medium, the process cartridge comprising:

the image carrying member positioned to oppose the transfer device when the process cartridge is removably installed in the image forming apparatus; and a guide member provided adjacent to and extending along a length of the image carrying member;

wherein:

the guide member is positioned so that, when the process cartridge is installed in the image forming apparatus, the guide member guides the transfer medium toward the image carrying member while supporting a side of the transfer medium on which the developer image is not transferred; and the guide member covers at least a part of the image carrying member.

14. The process cartridge according to claim 13, wherein the guide member guides the transfer medium such that a leading end of the transfer medium is guided toward the image carrying member at a position upstream, with respect to a feeding direction of the transfer medium, of a contact position between the image carrying member and the transfer device, when the process cartridge is installed in the image forming apparatus.

15. The process cartridge of claim 13, wherein the guide member is provided with a flexible film member extending away from the guide member and toward a position upstream, with respect to a feeding direction of the transfer medium, of a contact position between the image carrying member and the transfer device, when the process cartridge is installed in the image forming apparatus.

16. The process cartridge of claim 13, wherein the guide member is provided with at least one projecting structure capable of enhancing rigidity of the guide member.

17. The process cartridge of claim 16, wherein the at least one projecting structure is rib-shaped and extends along a bottom surface of the guide member in a direction transverse to a length of the image carrying member.

18. An image forming apparatus, comprising:

a casing including a transfer device capable of transferring a developer image from an image carrying member to a transfer medium; and a process cartridge, the process cartridge comprising:

a frame including a first side wall, a second side wall, a bottom wall and a front wall;

an image carrying member supported by and extending between the first side wall and the second side wall in a manner that permits the image carrying member to rotate, the image carrying member projecting, at least in part, beyond a bottom surface of the bottom wall;

a guide member extending between the first side wall and the second side wall, the guide member forming part of the bottom wall;

a first opening in the bottom wall extending from the first side wall to the second side wall and provided between the front wall and the guide member; and a second opening in the bottom wall extending from the first side wall to the second side wall and provided between the guide member and the image carrying member.

19. The image forming apparatus according to claim 18, wherein the casing further comprises a path for removably installing the process cartridge in the image forming apparatus, and the path is provided substantially parallel to a feeding direction of the transfer medium in the image forming apparatus.

20. The image forming apparatus according to claim 19, further comprising:

a subcasing that accommodates the transfer device and the process cartridge;

an opening that communicates with the path, the opening being formed in the casing on a front side of the image forming apparatus; and a cover that opens or closes the opening.

* * * * *